US006359840B1

(12) United States Patent
Evans

(10) Patent No.: US 6,359,840 B1
(45) Date of Patent: Mar. 19, 2002

(54) MICROCONTROLLER REGULATED QUARTZ CLOCK

(75) Inventor: Melville B. Evans, Largo, FL (US)

(73) Assignee: James W. Freese, Canton, MI (US)

( * ) Notice: Subject to any disclaimer, the term of this patent is extended or adjusted under 35 U.S.C. 154(b) by 0 days.

(21) Appl. No.: 09/323,390

(22) Filed: Jun. 1, 1999

(51) Int. Cl.[7] ..... G04B 19/04; G04B 19/24; G04B 25/00

(52) U.S. Cl. ..... 368/80; 368/28; 368/368; 368/223

(58) Field of Search ..... 368/28, 76, 80, 368/107–109, 157, 160, 223, 228; 307/141, 141.4

(56) References Cited

U.S. PATENT DOCUMENTS 4,479,723 A * 10/1984 Shida ..... 368/157
4,494,879 A * 1/1985 Meisner ..... 368/76
4,866,684 A * 9/1989 Besson ..... 368/108
5,044,961 A * 9/1991 Bruskewitz ..... 434/304
5,239,523 A * 8/1993 Chin-Hsing ..... 368/63
5,473,580 A * 12/1995 Gilomen et al. ..... 368/28
5,646,913 A * 7/1997 Quesenberry ..... 368/223
6,108,279 A * 8/2000 Hara ..... 368/157

* cited by examiner

*Primary Examiner*—Vit Miska
(74) *Attorney, Agent, or Firm*—Alex Rhodes

(57) ABSTRACT

A generic clock with a mechanically driven display, a standard quartz movement and a microcontroller which is programmed to turn mechanically driven features such as clock hands and counters "on" and "off" during prescribed intervals of time. A large number of novel derivative clocks can be produced by merely re-programming the microcontroller and making simple revisions to the mechanically driven display. During each tick of the clock, a set of instructions to the microcontoller pulses a stepper motor of the clock in short intervals to further extend the life of the clock's battery.

26 Claims, 10 Drawing Sheets

42

46

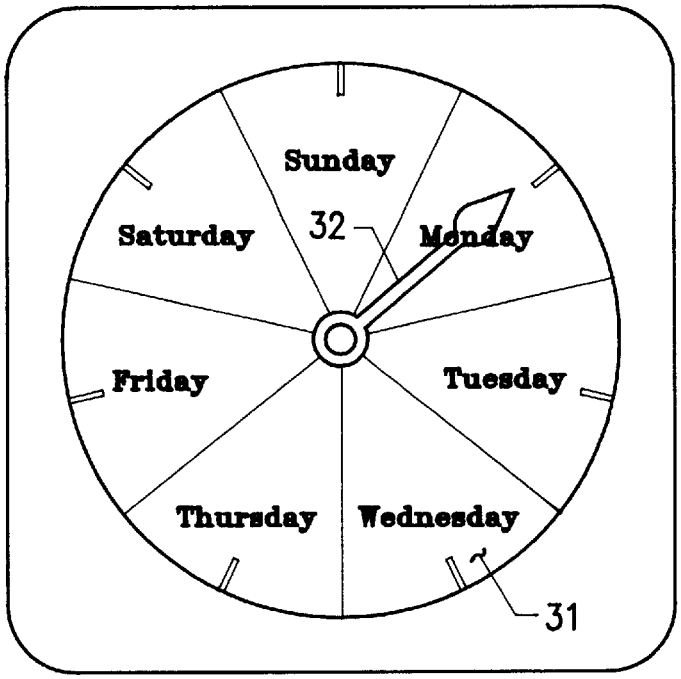
FIG. 3
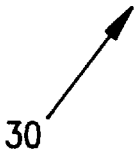
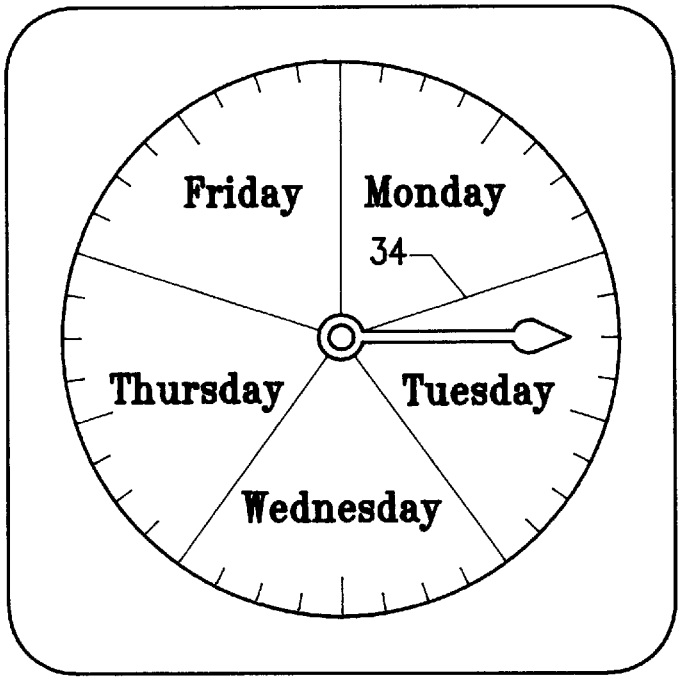
FIG. 4
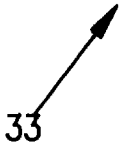

40

42

MICROCONTROLLER REGULATED QUARTZ CLOCK

FIELD OF THE INVENTION

This invention relates to clocks and more particularly to a generic clock with a mechanically driven display, a standard quartz movement and a microcontroller which is programmed to turn mechanically driven features such as clock hands and counters "on" and "off" during prescribed intervals of time.

BACKGROUND OF THE INVENTION

The standard quartz clock with mechanically driven hands has evolved into a low cost, highly accurate time piece. In this type of clock, a quartz crystal oscillator produces a sequence of pulses which drive the hands via a stepper motor and gear train so efficiently that the clock's accuracy is held to within one minute per month for more than a year. In some clocks of this type counters and other features are driven in the same manner. High production rates and efficient manufacturing practices have reduced the manufacturing cost of the movement of the standard quartz clock to slightly more than the cost of an alkaline "AA" battery power supply. The outstanding performance and low cost of the quartz movement have discouraged others from making changes to the quartz movement.

SUMMARY OF THE INVENTION

The present invention overcomes the resistance to changes to the mechanical quartz movement by incorporating a feature in the standard quartz movement which provides benefits and features heretofore unavailable. The feature is a low cost programmable microcontroller. The effect of the programmable microcontroller is so remarkable that the efficiency of the standard quartz movement can be substantially increased. Moreover, a common quartz movement can be used for a large variety of novel clocks.

The invention resides in the ability of the low cost programmable microcontroller to act in combination with the standard quartz movement to cause a clock's mechanical features such as hands and counters to "sleep" (stop) and "awake" (start) during prescribed intervals of time.

The low cost programmable microcontroller (computer chip), responds to the clock's crystal oscillator by turning "on" and "off" the stepper motor which drives the clock's hands, counters and other features via a gear train. The ability of the microcontroller to turn the stepper motor "on" and "off" according to a programmed set of commands provides a number of important benefits.

One benefit is that battery life is substantially increased because current draw is interrupted when the stepper motor is turned "off". Another benefit is that the size of the standard quartz movement can be reduced by replacing its alkaline or NiCad "AA" battery with a small low cost lithium battery.

Still yet another benefit is that a lithium battery can be used so efficiently that the battery's service life is about equal to the life of the clock. Still yet another benefit is that a variety of novel clocks are derived with a common standard quartz clock movement by merely changing displays and re-programming the microcontroller. For example, the microcontroller can be re-programmed to drive an hour or minute hand shaft of an existing clock with the standard -quartz movement to produce a 12-hour clock, a 7-day clock, an ocean tide clock, etc.

A further benefit is that a programmable microcontoller is lower in cost than unique gear trains because of investment savings, inventory savings and higher production rates. Still yet another benefit is that ancillary features, such as alarms, beeps, snooze buttons and dial lamps can be easily incorporated by simple modifications to microcontroller software.

In employing the teaching of the present invention, a plurality of alternate constructions can be adopted to achieve the desired results and capabilities. In this disclosure, some alternate constructions are discussed. However, these embodiments are intended as examples, and should not be considered as limiting.

Further objects, benefits and features of the invention will become apparent from the ensuing detailed description and drawings which illustrate and describe the invention. The best mode which is contemplated in practicing the invention together with the manner of using the invention are disclosed and the property in which exclusive rights are claimed is set forth in each of a series of numbered claims at the conclusion of the detailed description.

BRIEF DESCRIPTION OF THE DRAWINGS

The invention will be better understood and further objects, characterizing features, details and advantages thereof will appear more clearly with reference to the diagrammatic drawings illustrating a presently preferred specific embodiment of the invention by way of non-limiting example only.

FIG. 3 is a front view of a day clock according to the present invention.

FIG. 4 is a front view of a forty-hour clock according to the present invention.

DESCRIPTION OF THE PREFERRED EMBODIMENT

Figure 1:
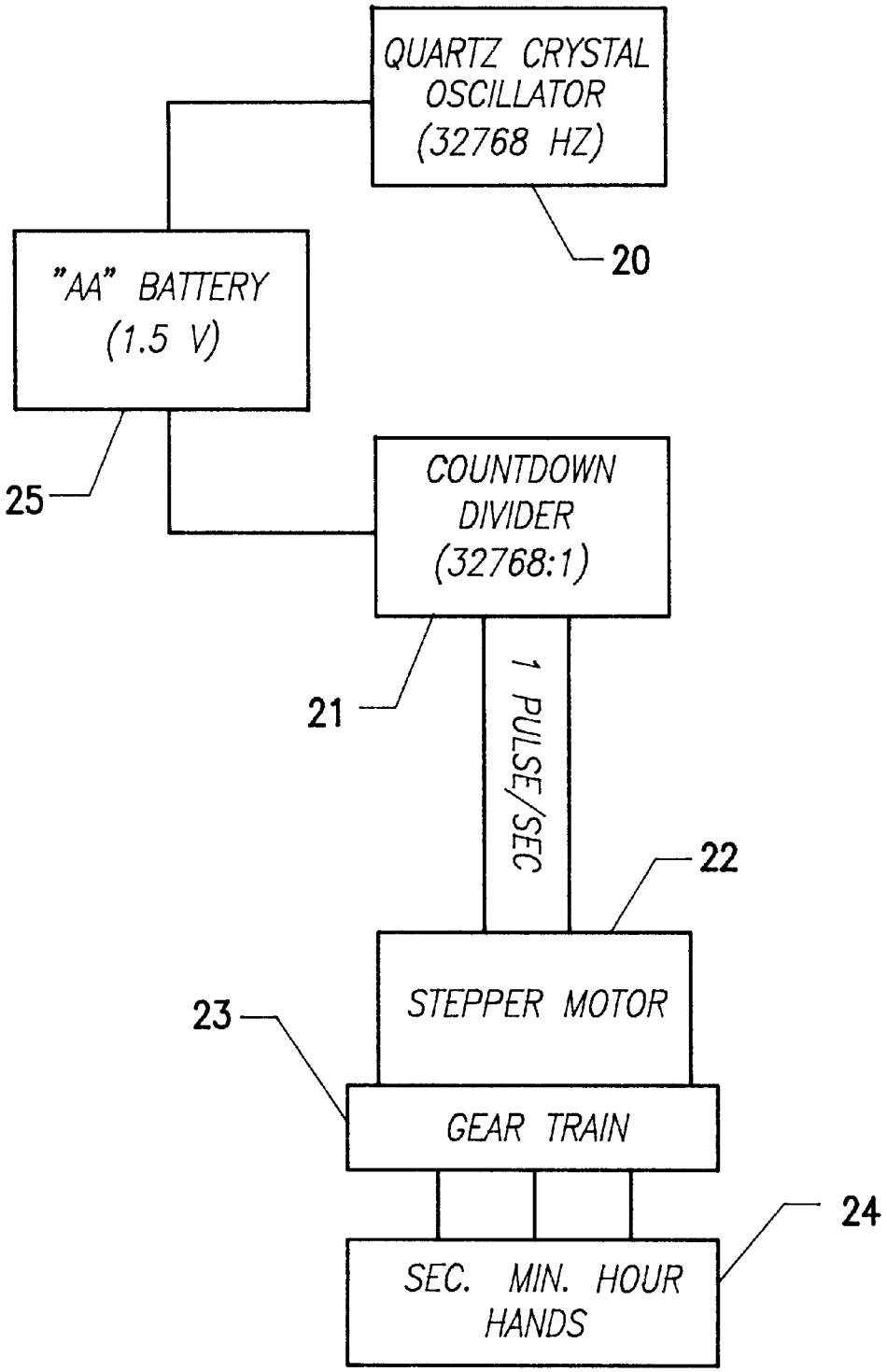
PRIOR ART FIG. 1
FIG. 1 is a block diagram of a conventional mechanical quartz clock.

Referring now to the drawings wherein like numerals designate similar and corresponding parts throughout the several views, a block diagram of an existing Quartex Q84 movement (Lake Geneva, Wis., USA) is shown in FIG. 1 which illustrates a standard quartz mechanical movement. The standard quartz mechanical movement comprises a quartz crystal oscillator 20, a countdown divider 21, a stepper motor 22, a gear train 23 and hands 24 of a clock. As shown in the block diagram, a 32768 Hz train of pulses, generated by the quartz crystal oscillator 20, is reduced to a 1 Hz. frequency in the 32768:1 countdown divider 21. The 1 Hz. divider output triggers the stepper motor 22 which drives the gear train 23. The gear train 23 rotates the hour, minute and second hands 24 of the clock.

The quartz crystal in the oscillator 20 of the standard movement is a high volume, mass-produced, crystal which varies in frequency from part-to-part to about less than 20 parts-per-million. The drift of the standard movement's frequency is frequently quoted as less than one minute per month (23 parts per million). Low cost plastic gears without jewels of the gear train 23 drive the stepper motor 22 and do not require a manufacturing adjustment. The manufacturing cost of the standard movement is low.

The quartz oscillator 20 and countdown divider 21 draw negligible amounts of battery current. Almost all of the battery current is used by the stepper motor 22 which drives the gear train 23. A typical tick pulse requires 6 milliamps of current to drive the motor's coil for 47 milliseconds, during which time the motor's rotor rotatably "steps" 180 degrees. The 180 degree rotation rotates the second hand 6 degrees (one second-tick).

The common alkaline "AA" battery 25 delivers 2.2 amp-hours to a clock which is equivalent to 28 million ticks. At one tick per second, the life of the alkaline battery 25 is about 324 days.

One important benefit of the present invention is that battery life is substantially increased. This is accomplished by programming the microcontroller 26 to stop and start the clock's hands 24 and to match stepper motor dynamics with battery chemistry. The microcontroller 26 is programmed to start and stop the hands 24 during the prescribed intervals of time and to pulse the stepper motor's coil in short intervals during each tick while using the inertia of the stepper motor's rotor between pulses to produce a reliable tick at a minimum of current.

It was determined by testing that the shortest "solid" pulse for producing a reliable tick in the standard movement which was tested was a 3 volt pulse for 12 milliseconds. Further tests established that the reliable tick could also be achieved by pulsing the stepper motor coil with a 3 volt pulse for 4 milliseconds to initiate rotation of the stepper motor rotor; allowing the rotor to coast for 3 milliseconds; pulsing the stepper motor coil at 3 volts for 1 millisecond; allowing the stepper motor to coast for 3 milliseconds; and pulsing the stepper motor coil at 3 volts for 1 millisecond.

Thus, by pulsing the stepper motor's coil with the microcontroller 26 in short intervals, using the inertia of the stepper motor rotor between pulses to allow the stepper motor's rotor to coast, the total time of battery current for producing the reliable tick was reduced from 12 milliseconds to 6 milliseconds. If the timing of the "pulse" periods and the open-circuit "coast" periods are matched to the rotational momentum of the stepper motor, the rotor can be made to "spin", for any number of revolutions, with very little additional energy required to maintain the motion.

Heretofore, little attention has been paid by clock designers to the effect of a battery's chemistry on its performance. A lithium battery exhibits seldom appreciated "recovery" effects. It performs best if current is drawn in short amounts, with sufficient time intervals between uses. It requires time for its output voltage to recover. The more severely a lithium battery is used, the more time is needed for recovery. Heavy loads can render it ineffective in a matter of hours. By pulsing the stepper motor's coil with the microcontroller 26 in a series of short intervals, the life of a Panasonic CR2032 lithium battery was substantially extended in a twelve-hour clock.

The invention was evaluated by adapting a low cost Microchip Technology, Inc. PIC 12C508 microcontroller 26 to a Quartex Q84 mechanical quartz movement. The PIC 12C508 microcontroller 26 is a microprocessor together with some (or all) support peripherals (clock, memory, input/output circuits, etc.) on a single silicon chip. It is exemplary of the current state of the art. It needs no "glue" parts (additional components for interfacing to the outside circuit). Six of its eight pins can be used for input/output; however only five were used.

In an "active" mode, a built-in microcontroller clock allows execution of one million instructions per second, so real-time tasks are quickly performed. After completing a real-time task, the PIC 12C508 was programmed to "sleep", drawing a current of less than one microamp, until the next task comes along. In the present invention, the tasks assigned to it are relatively simple. The PIC 12C508 microcontroller 26 spends more than 99% of its time sleeping. Average power is reduced and battery life is significantly extended over the standard movement.

Figure 2:
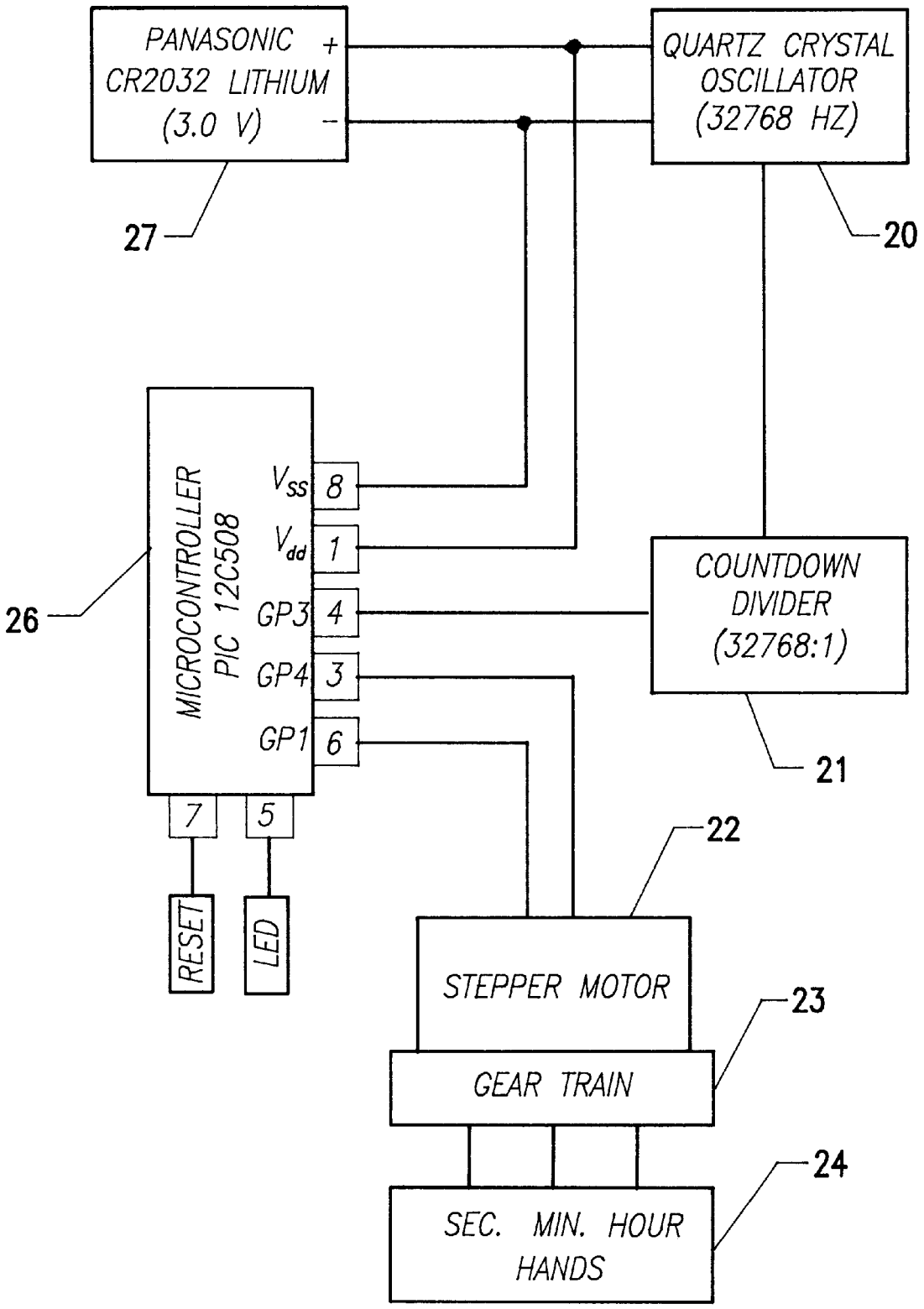
FIG. 2 is a block diagram of the present invention.

The PIC 12C508 microcontroller 26 was added as shown in FIG. 2 to the Quartex Q84 movement by cutting two traces on a printed circuit board going from the countdown divider 21 to the stepper motor 22 and bringing five leads from the PIC 12C508 microcontroller 26: two to the battery 27, two to stepper-motor 22, and one to the countdown divider 21.

The 1.5V "AA" alkaline battery 25 of the Quartex Q84 standard movement was replaced with a Panasonic CR2032 3.0V lithium cell 27. The 3.0V cell 27 powered both the quartz crystal oscillator 20 and the PIC 12C508 microcontroller 26. A pulse on the line from countdown divider 21 (every two seconds) to the PIC 12C508 input pin woke up the sleeping microprocessor to perform a simple task, namely, to update the real-time clock and decide whether or not to drive the stepper motor 22. If not, the stepper motor 22 continued to sleep until another pulse came along. When it was time to drive the stepper motor 22, the two microprocessor output pins sent a sequence of bipolar pulses (tailored for minimum energy) to move the stepper motor's rotor a number of steps specified by a programmed "function". Some of the more sophisticated functions which were evaluated required a pushbutton switch 28 to "reset" input and/or a diode-lamp 29 for an "annunciator" output.

The 3V DC, Panasonic CR2032 battery 27 which powered the crystal oscillator 20 and the PIC 12C508 microcontroller 26 is a low cost lithium coin cell 27. Its cost has been steadily decreasing, and is now little more than the alkaline "AA" cell 25. However, the lithium battery 27 has a much longer shelf life.

The shelf life of the Panasonic CR2032 lithium battery 27 is quoted as "about ten years"; shelf life being the length of time over which internal leakage reduces its energy capacity to one-half the life of a factory-fresh cell. The manufacturer quotes its CR2032 battery 27 as having a capacity of 210 mah (milliamp-hours). If capacity is reduced by one half after 10 years (87,600 hrs.), leakage current in milliamps can be computed in the following manner:

$$105/87600=0.0012 \text{ ma}=1.2 \text{ microamps}$$

In the present invention, current of the Panasonic lithium CR2032 battery 27 is used so sparingly, that the average running current is considerably less than the above leakage current. Since at least half of the capacity of a new Panasonic CR2032 battery 27 should be available after ten years, it is believed that the present invention can be used for 10 or more years with the same Panasonic CR2032 battery 27.

The Panasonic CR2032 battery 27 is available in "solder in" and "snap in" models. The "snap-in" model requires battery clips and a power-on reset switch, both of which require a great deal of space and increased cost. Moreover, the pressure contacts of battery clips are not long-term reliable. One benefit of the present invention is that the low battery drain makes a "solder in" battery an attractive candidate for reducing cost and space as well as improving reliability.

Several clocks, which are exemplary but not limiting of the use of the present invention were evaluated. These clocks are illustrated in FIGS. 3 through 13. In each example, an existing clock was modified by changing the dial face, adding the programmable microcontroller and programming the microcontroller to start and stop the hour and/or minute or second hand shafts in prescribed manners.

Day Clock (Seven-Day Movement, FIG. 3)

The day clock 30 is intended for retirees and other individuals who neither wear nor need a wristwatch. The hours don't matter, but the days still do. By way of example, Tuesday may be golf day or Wednesday may be reserved for dinner at the club. The clock 30 features a large display 31 (readable without glasses) of the seven days of the week.

A single hand 32 rotates at a constant rate of once per week. Heretofore, seven-day movements used special crystals and/or special gearing, and were expensive. The low cost PIC 12C508 microcontroller programmed movement, can use either the hour hand of the standard movement, driven by the microcontroller at 1/14 normal speed; or the minute hand of the standard movement, driven by the microcontroller at 1/168 normal speed. Using the minute hand, a battery 27 that normally lasts a year would theoretically keep the clock ticking for 168 years.

Forty-Hour Clock (FIG. 4)

The forty-hour clock 33 is intended for persons with 8:00 A.M. to 5:00 P.M. jobs, without work on weekends. A single hand 34 starts the week at the top, at 9:00 A.M. on Monday, and heads toward a stubby line near mid-day which indicates "lunch-time". The hand 34 arrives at noon, and stops for lunch. At 1:00 P.M. it starts moving again, heading for the line between Monday and Tuesday which indicates "quitting-time". It arrives there at 5:00 P.M., and quits for the day. On Tuesday, Wednesday, and Thursday, the same events occur. Friday is special, a red-letter day. As a handy reminder, the lunch-line is twice as long.

Figure 5:
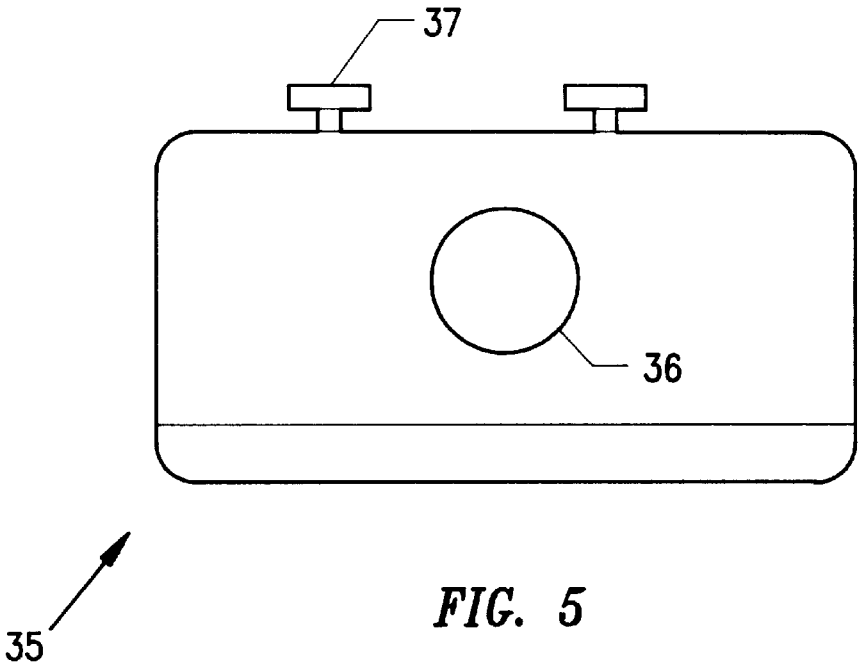
FIG. 5 is a plan view of an alarm day clock according to the present invention.
Figure 6:
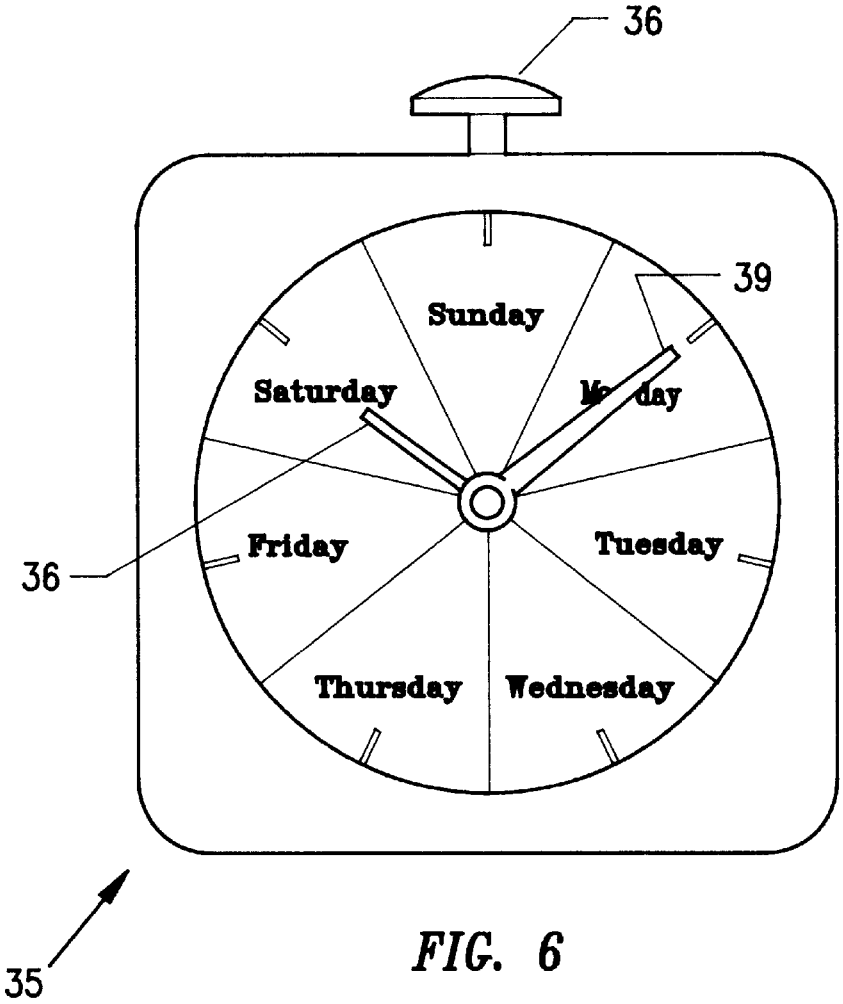
FIG. 6 is a front view of the alarm day clock.

Alarm Day Clock (FIGS. 5 and 6)

The alarm day clock 35 is a derivative of an alarm clock with a standard movement, an alarm hand 36; an alarm set knob 37; a beeper (inside the case); and a "snooze" switch-button 38. The clock is converted to the alarm day clock by using the hour hand 39 to point to the day. The speaker beeps on the day and at the time of day, indicated by the alarm hand 36.

The alarm function is set by lifting the snooze button 38 in the usual manner to enable the alarm. When the hour hand 39 arrives at the alarm hand 36, the beeper sounds to indicate an event, such as "golf time". Depressing the snooze button 38 turns off the alarm.

In addition to converting the hour hand 39 into a day hand, the microcontroller 26 can be programmed to broadcast, via a speaker, messages and music, such as,"find your clubs, it's golf time!", followed by a tune.

Figure 7:
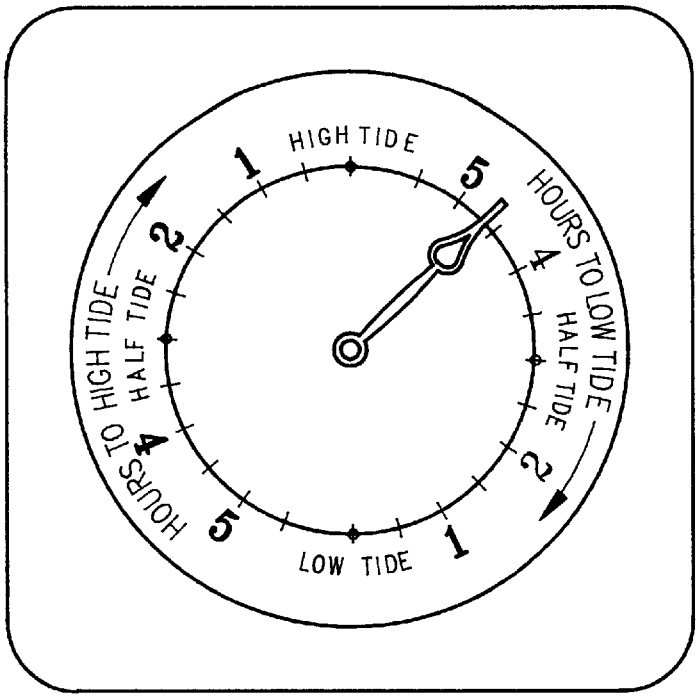
FIG. 7 is a front view of a tide clock according to the present invention.

Tide Clock (FIG. 7)

Existing tide clocks require expensive planetary gearing to convert the hour hand into a "tide" hand which rotates once per lunar day (22 hours, 50 minutes). The PIC 12C508 microcontroller 26 can perform better. The tide has several components—the strongest (lunar) tide has a period of 22 hours, 50 minutes; and the next-strongest (solar) tide has a period of 24 hours. The clock 40, shown in FIG. 7, operates on sideral ("real") time, using both lunar and solar components; with the hand 41 advancing from a positive peak ("High Tide") to a next negative peak ("Low Tide"). A reset pushbutton (not shown) on the back of the clock 40 allows the clock 40 to be reset at either full-moon or new-moon high tide.

Figure 8:
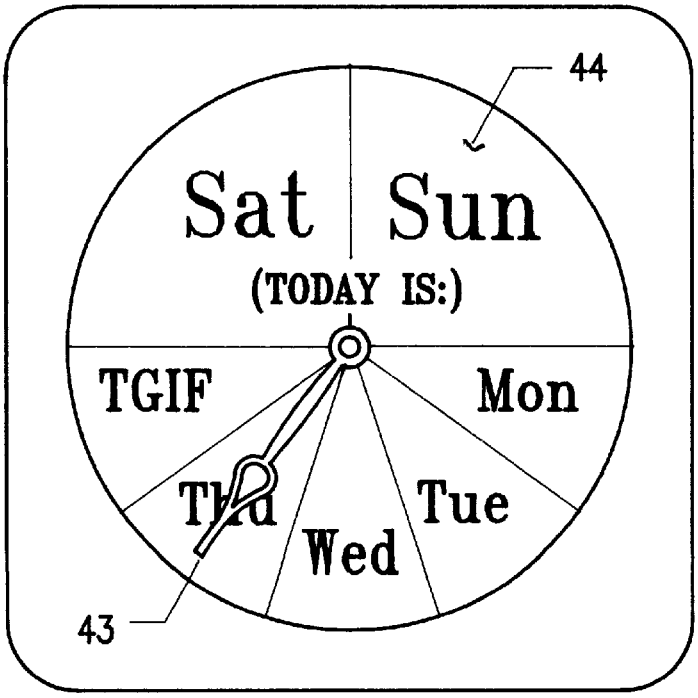
FIG. 8 is a front view of an office clock according to the present invention.

Office Clock (FIG. 8)

The two-speed movement of the office clock 42 weighs the days as they should be. It provides more "time" on weekends, and Friday is a red-letter day. The hand 43 takes two days to traverse the top half of the dial 44, and five days to traverse the bottom half. A reset button (not shown) on the back lets you set it at noon on any day of the week. A battery 27 inside the case has a life of at least ten years.

Figure 9:
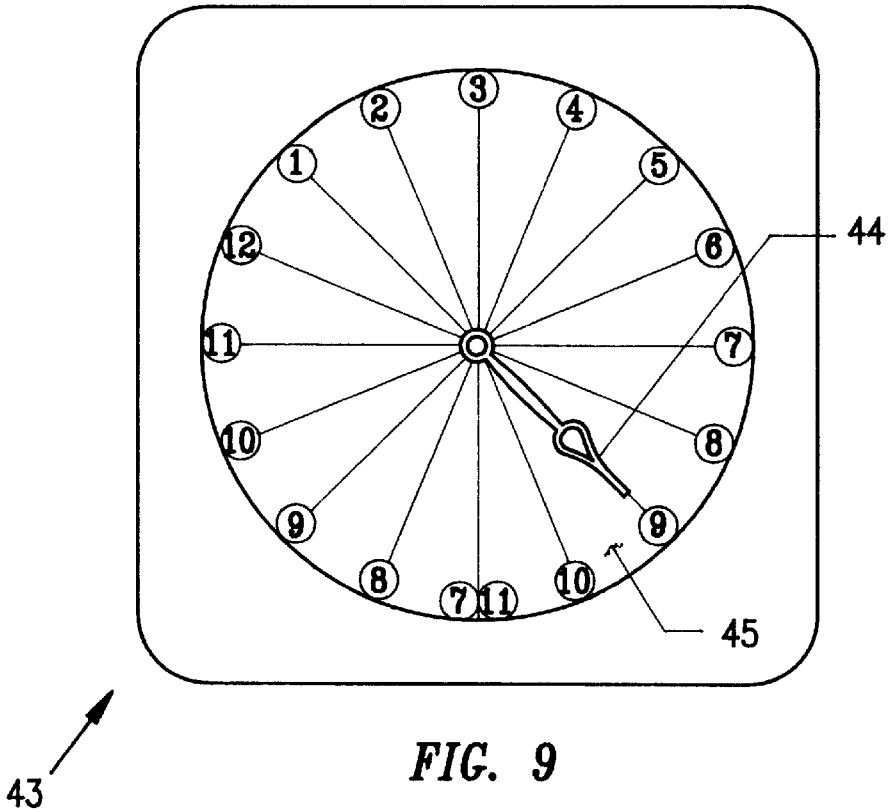
FIG. 9 is a front view of a seven-eleven clock according to the present invention.

Seven-Eleven Clock (FIG. 9)

The seven-eleven clock 43 sleeps when you do. Its hand 44 starts at the bottom at 7:00 A.M. and advances steadily around the dial 45. At 3:00 P.M. the hand is at the top: halfway through your day. It reaches bottom at 11:00 P.M., and stops there until 7:00 A.M. tomorrow morning. A reset button (not shown) on the back of the clock 43 allows you to set it, on the hour, at any hour of the day. A battery 27 inside of the case has a life of at least ten years.

Figure 10:
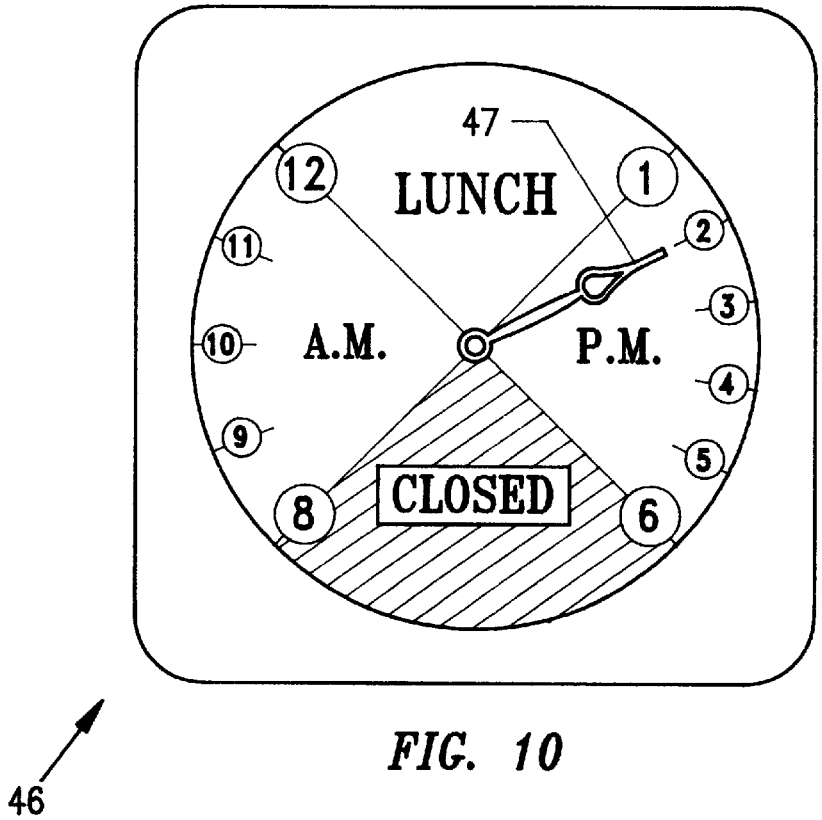
FIG. 10 is a front view of a store clock according to the present invention.

Store Clock (FIG. 10)

The three-speed movement of the store clock 46 gives LUNCH and CLOSED the importance they deserve. The hand 47 covers the left quadrant between 8:00 A.M. and noon, the top quadrant between noon and 1:00 P.M., the right quadrant between 1:00 P.M. and 5:00 P.M., and the bottom quadrant between 5:00 P.M. and 8:00 A.M. A battery 27 inside of the case has a life of at least ten years.

Figure 11:
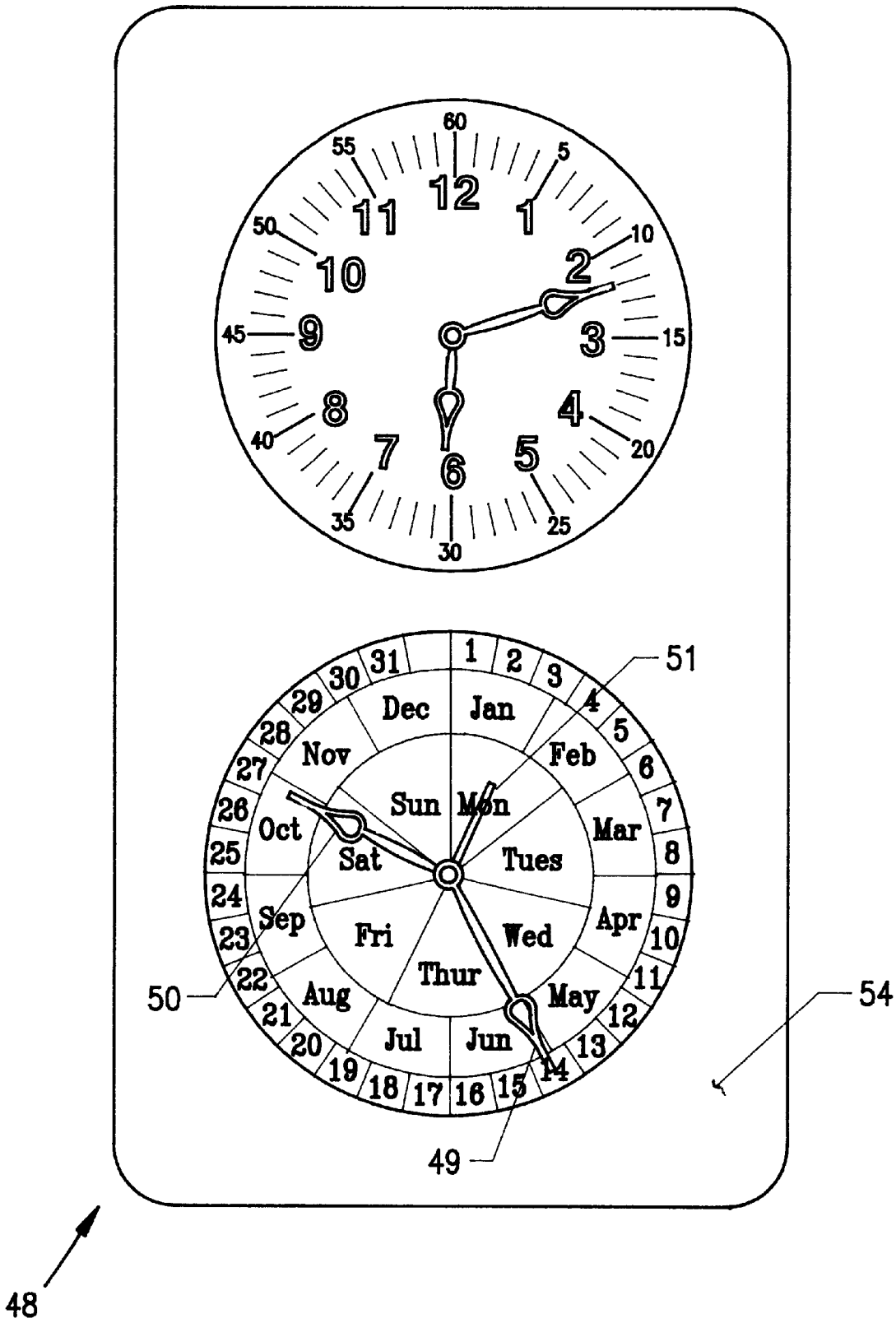
FIG. 11 is a front view of a perpetual calendar clock according to the present invention.

Perpetual-Calendar Clock (FIG. 11)

The perpetual-calendar clock 48 has three functions—date (minute hand 49, outer indicia), month (hour hand 50, center ring), and week day (second hand 51, center indicia). The day hand 49 advances once per day, at midnight; and uses about 100 ticks per advance. A standard clock, at one tick per second, uses 86400 ticks per day, and the battery lasts about a year. At only 100 ticks per day, the lithium battery 27 of the perpetual calendar clock 48 has a theoretical life of 864 years. The hour hand 50 points to the month (January through December), the minute hand 49 to the date (1 thru 31), and the second hand 51 to the day of the week (Sunday through Saturday). Week days go counter-clockwise, so standard gearing can be used.

The calendar is perpetual, it recognizes leap years, the year 2000, and the year 2400, so it will never become obsolete. Since average running current is considerably less than internal leakage current, the life of the battery 27 is indeterminate and its exact value will have to be determined by actual use.

Figure 12:
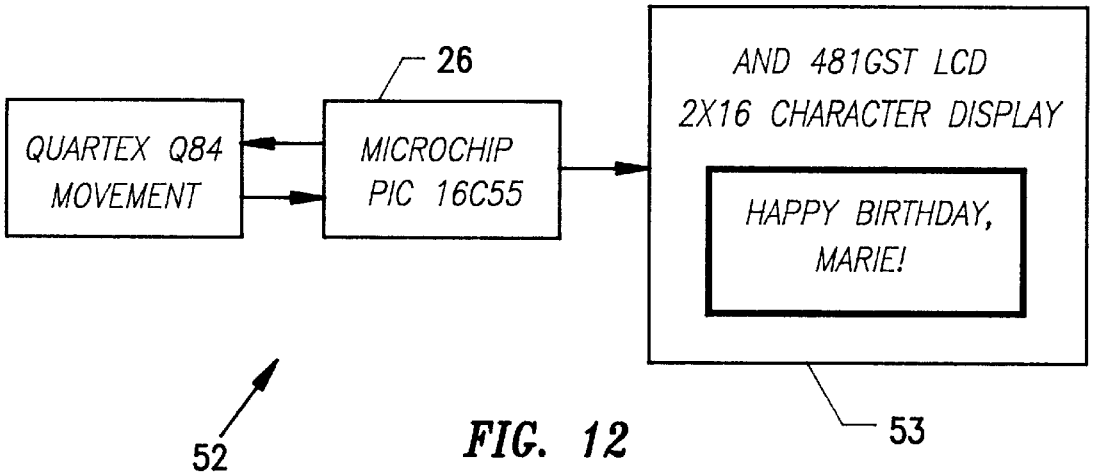
FIG. 12 is a block diagram of an enhancement of the calendar clock.

An enhancement of the calendar clock 48 is shown in the block diagram of FIG. 12. A liquid crystal display (LCD) 53 on the face 54 of the clock 48 displays reminders and notices at dates which are prescribed by the microcontroller's software. A Microchip PIC 16C55 microcontroller 26, having 12 I/O lines, is used to drive the LCD 53.

Figure 13:
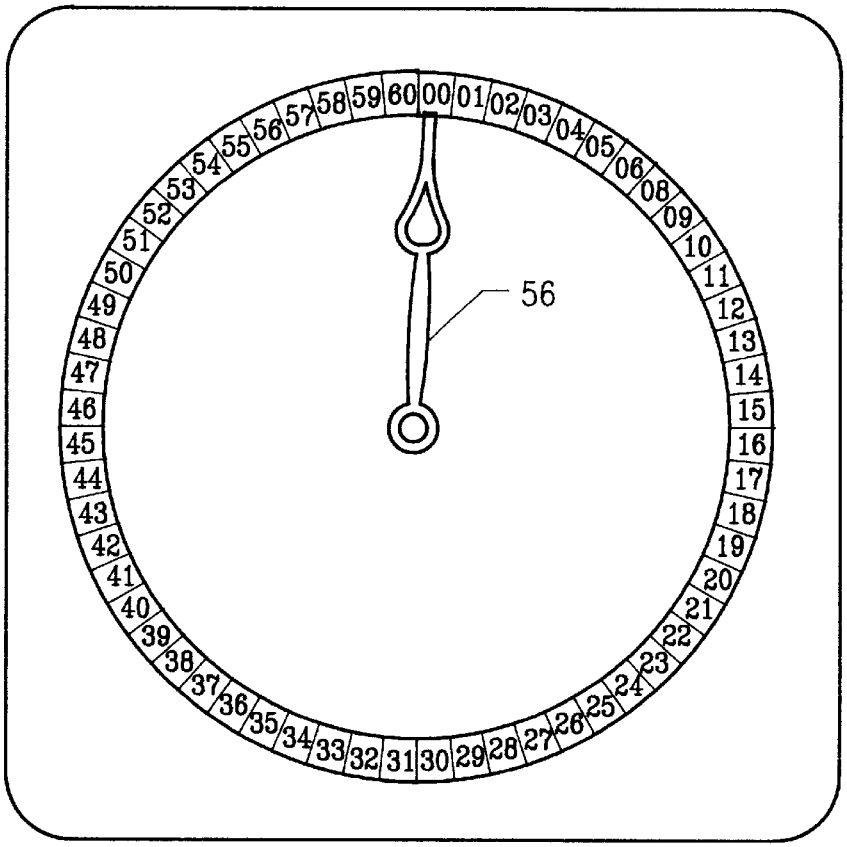
FIG. 13 is a front view of a forever (everlasting) clock according to the present invention.

Forever (Everlasting) Clock (FIG. 13)

In the forever (everlasting) clock 55, the second hand 56 rotates one tick per year or 60 ticks (a full revolution) in 60 years. In the alternative, the minute hand ticks 60 times per year, or 5 ticks per month, for a finer resolution. With either hand, during one complete revolution, the hands traverse 60 years.

MICROCONTROLLER SOFTWARE

The heart of the software which is common to each derivative of the standard quartz clock is a real-time update routine. Once every two seconds (when a pulse is received), the real-time clock is updated and it is decided whether to send out a tick sequence. If not, the clock goes back to sleep. If it is, a tailored tick pulse (or pulses) is sent out, and then the clock goes back to sleep.

The following is the real-time clock update routine in PIC assembly language:

```
Main    ;process clock pulse (GP3 wakeup from sleep)
        incf    Seccnt,F        ;increment pulse count (0–59)
        movf    Seccnt,W        ; to W for check
        iflt    60,tick?        ; if less than 60, go to "tick?"
        clrf    Seccnt          ; else, reset second count to zero
        incf    Mincnt          ; and increment minute count (0–59)
        movf    mincnt          ; to W for check
        iflt    60,tick?        ; if less than 60, go to "tick?"
        clrf    Mincnt          ; else, reset minute count to zero
        incf    Hourcnt,F       ; and increment hour count (0–23, 0=midnite)
        movf    Hourcnt,F       ; to W for check
        iflt    24,tick?        ; if less than 24, go to "tick?"
        clrf    Hourcnt         ; else, reset hour count to zero,
        incf    Daycnt,F        ; increment day count (0–6, 0=Saturday),
        movlw   1
        movwf   Dflag           ; and set end-of-day flag
        movf    Daycnt,W        ; day count to W for check
        iflt    7,incdat        ; if less than 7, go to "incdat"
        clrf    Daycnt          ; else, reset day count to 7 (Saturday)
incdat          incf Datcnt, F  ;date (1–28,29,30 or 31)
        movf    Mnthcnt,W       ; check mont 91–12)
        iflt    2,mn31                  ; Jan
        iflt    3,mnfeb           ; Feb
        iflt    4,mn31                  ; Mar
        iflt    5,mn30            ; Apr
        iflt    6,mn31                  ; May
        iflt    7,mn30            ; Jun
        iflt    8,mn31                  ; Jul
        iflt    9,mn31            ; Aug
        iflt    10,mn30           ; Sep
        iflt    11,mn31           ; Oct
        iflt    12,mn30           ; Nov
        goto    mn31            ; Dec
mn30    movf    Datcnt,W
        iflt    31,tick?
        movl    1
        movwf   Datcnt            ; reset 31 to 1
        incf    Mnthcnt,F       ; increment month
        movlw   4
        movwf   Mflag           ; set end-of-month flag to 4
        goto    tick?
mn31    movf    Datcnt,W
        iflt    32,tick?
        movlw   1
        movwf   Datcnt            ; reset 32 to 1
        incf    Mnthcnt,F       ; increment month
        movlw   2
        movwf   Mflag           ; set end-of-month flag to 2
        movf    Mnthcnt,W
        iflt    13,tick?        ; if not Dec
        movlw   1
        movwf   Mnthcnt           ; reset 13 to 1 (Jan)
        incf    Year,F            ; increment year (00–99)
        movf    Year,W
        iflt    100,tick?
        clrf    Year
        incf    Cent,F            ; increment century
        goto    tick?
mnfeb   movf    Datcnt,W        ; sort out Feb
        iflt    29,tick?        ; if not 29 or 30
        iflt    30,ckleap       ; if 29
        goto    fb29            ; if 30
ckleap          movf Year,W           ;check if leap year
        andlw   b'00000011'
        btfss   STATUS,Z        ;divisible by 4?
        goto    fb28            ; no, so not leap year
        movf    Cent,W                ; check century
```

-continued

```
        andlw   b'00000011'
        btfss   STATUS,Z        ; divisible by 4?
        goto    tick?           ; no, so leap year 9 keep Feb 29)
fb28    movlw   8
        movwf   Mflag           ; set end-of-month flag to 8
        goto    fbend
fb29    movlw   6
        movwf   Mflag           ; set end-of-month flag to 6
fbend   incf    Mnthcnt,F       ;reset to 1 Mar
        movlw   1
        movwf   Datcnt
tick?   ;to tick or not to tick ???
```

Ignoring the source code at the left side of each line, it is clear from the comments following the semi-colons, that the code acts as if updating occurs once per second. Only one of the two pulse trains is used, which gives one pulse every two seconds. The PIC 12C508 microcontroller allows the use of the pulse's leading edge to be used for one interrupt and the trailing edge for another interrupt. Updating occurs twice every two seconds.

At the beginning variable Seccnt ("second count") is incremented (bumped up). If it is less than 60 (and most times it is) the program advances to label "tick?" at the bottom. If it is finally up to 60, the program resets the microcontroller to zero and increments Mincnt ("minute count"). If it is less than 60 (most times, again), we're done.

The program advances through hour count, day count, date count, figuring the number of days per month, month count, year count, and century count.

For most cases, only the first three lines are used, updating Seccnt. Running at a clock frequency of 1 MHZ, the PIC 12C508 microcontroller executes the line in 9 microseconds, and then sleeps. Occasionally, it must complete the entire procedure before getting to "tick?". The worst case takes 65 microseconds. The average time per clock update is slightly more than the first 9 microseconds.

During the PIC's active time the PIC draws about 1.8 milliamps, or 1800 microamps from the battery. During sleep, current drain of the battery is about 0.25 microamps. The duty cycle, every 2 seconds, is 1800 microamps for 10 microseconds followed by 0.25 microamps for the next 1,999,990 microseconds. Excluding ticks, the average battery current drain is (1800×10+0.25×1999990)/2000000=0.259 microamps.

When a tick occurs, there is a lot of current for a relatively long time, i.e. 12 milliamps for 12 milliseconds. If this occurs once per second, by way of example in a twelve hour clock, the average current drain from ticks is ((12 ma×12 msec)+(0 ma×988 msec))/1000 msec=0.144 milliamps or 144 microamps. Thus, standard-rate ticks consume battery current at 556 times the PIC. Most of the battery current is used by the stepper motor.

Figure 14:
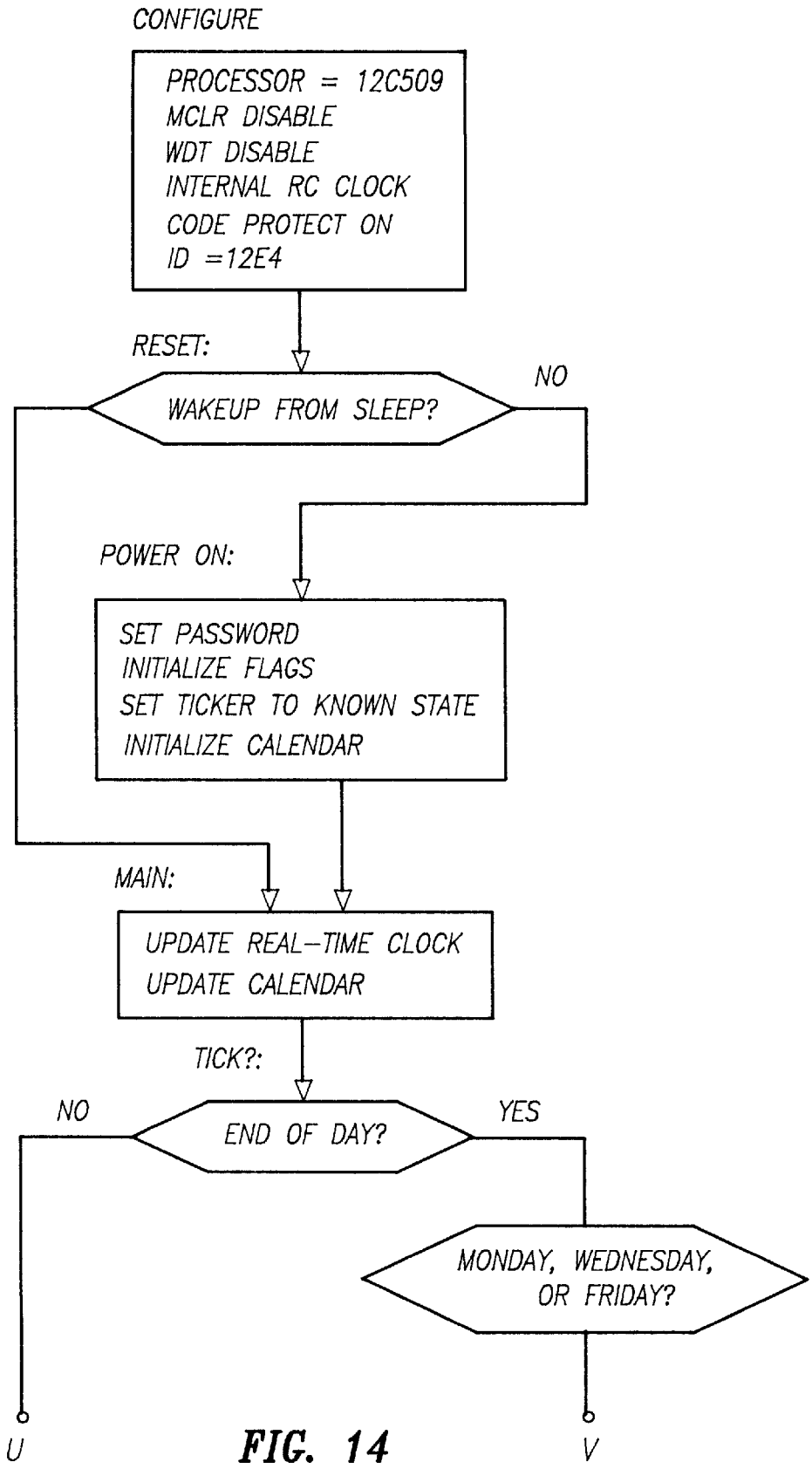
FIG. 14 is a partial logical flow diagram of a date clock.
Figure 15:
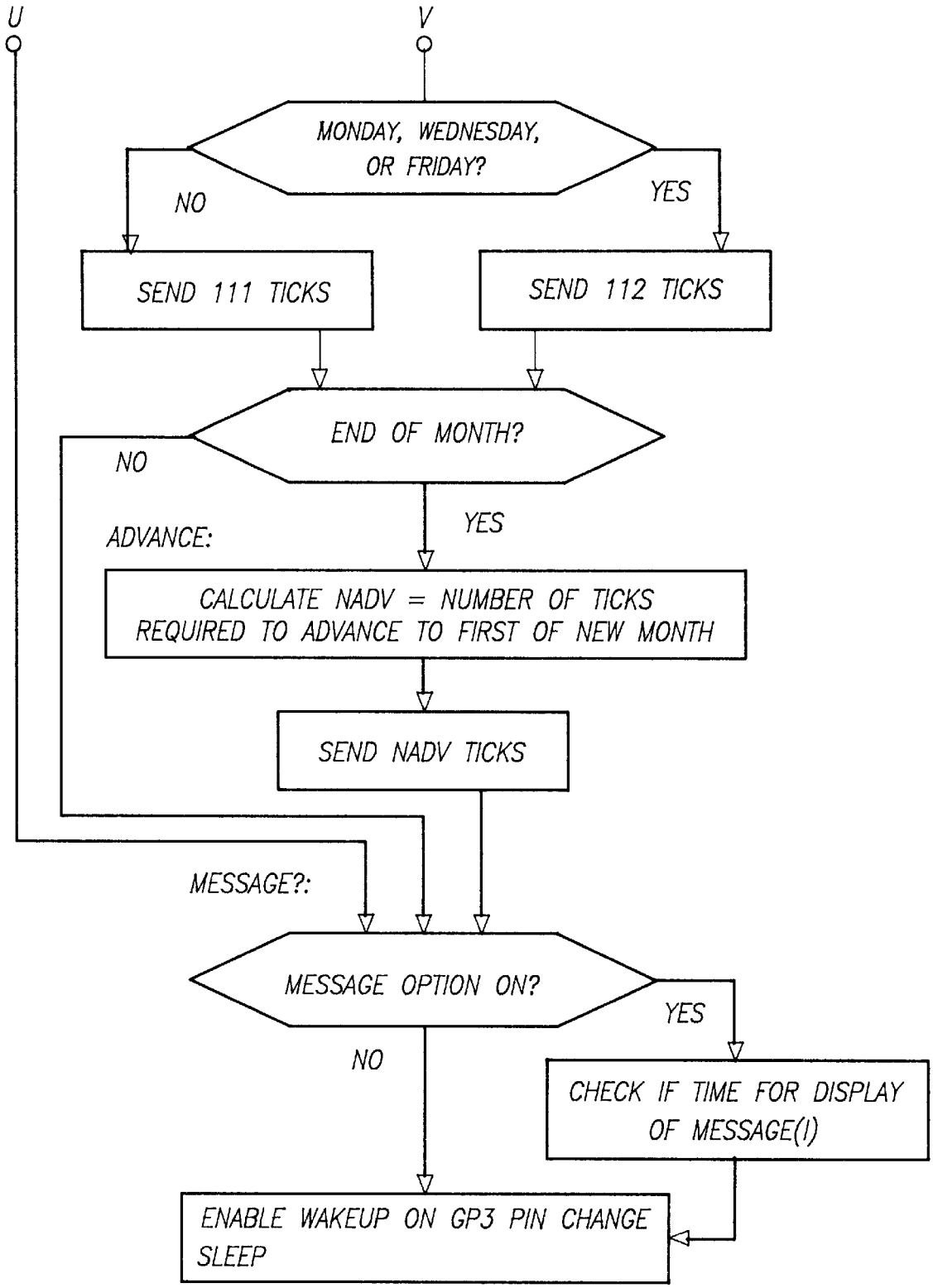
FIG. 15 is a continuation of the flow diagram in FIG. 14.

In FIGS. 14 and 15 a logical flow diagram is shown for a calendar (month-date-day) clock.

From the foregoing, it will be understood that my invention provides features and benefits in clocks with standard quartz movements and mechanically driven displays previously unavailable. Moreover, the invention further provides an effective, low cost means for extending the life of a clock's battery and of deriving a variety of novel clocks and features based on the standard quartz movement.

Although only several embodiments of our invention have been described it will be appreciated that other embodiments can be developed by obvious substitutions of parts and/or changes in material, shape and arrangement of parts without departing from the spirit thereof.

I claim:

1. In a clock, the combination of a movement for rotating at least one hand about a center of an analog display, said movement comprising, a battery, a quartz crystal oscillator, a stepper motor, a gear train, a programmable microcontroller for processing pulses from said quartz crystal oscillator to turn "on" and "off" said stepper motor during prescribed intervals of time, said analog display having at least one pair of sectors for indicating with said hand at least one pair of activities during each revolution of said hand; and a computer program for providing a set of instructions to said microcontroller for turning said stepper motor "on" and "off" during said prescribed intervals of time.

2. The combination set forth in claim 1 wherein said battery is of a type which performs best if current is drawn in short amounts, with sufficient time intervals between uses and said computer program further provides a duty cycle for said battery during each tick of said clock for substantially extending the life of said battery, a set of instructions to said microcontroller during each tick of said clock to pulse said stepper motor with a single shortest solid pulse which produces a reliable tick to substantially extend the life of said battery.

3. The combination set forth in claim 1 wherein said battery is a lithium battery and said set of instructions in includes instructions for substantially extending the life of said battery by pulsing said motor in a series of short pulses, said pulses comprising an initial pulse of about 3 volts for 4 milliseconds to initiate a rotation of said stepper motor, about a 3 millisecond pause to coast said stepper motor, a second pulse of about 3 volts for 1 millisecond to drive said stepper motor, about a 3 millisecond pause to coast said stepper motor, and a third pulse of about 3 volts for 1 millisecond to drive said stepper motor.

4. The combination set forth in claim 3 wherein said hand is a usual hour hand.

5. The combination set forth in claim 3 wherein said hand is a usual minute hand.

6. The combination set forth in claim 1 wherein said clock is a store clock and said display comprises a single rotatable hand and a clock dial which is divided into 4 sectors, one of said sectors corresponding to an A.M. "open" store activity, one of said sectors corresponding to a lunch activity, one of said sectors corresponding to a P.M. "open" store activity and one of said sectors corresponding to a "closed" store activity; and said computer program provides a set of instructions to said microcontroller to rotate said hand one revolution per day.

7. The combination set forth in claim 6 wherein said sectors are 4 equal sectors.

8. The combination set forth in claim 1 wherein said clock is an alarm day clock and said display comprises a pair of hands comprising an alarm set hand and a time hand and a clock dial which is divided into seven days; and said computer program provides a set of instructions to said microcontroller to execute to rotate said time hand one revolution per week.

9. The combination set forth in claim 8 wherein said instructions to said microcontroller include instructions to said clock to transmit a voice message at a prescribed time.

10. The combination set forth in claim 1 wherein said clock is a tide clock and said display comprises a rotatable hand and a clock dial which is divided into periods of a tide; and said computer program provides a set of instructions to said microcontroller to execute to rotate said hand to signal a period of said tide.

11. The combination set forth in claim 1 wherein said clock is an office clock and said display comprises a rotatable hand and a clock dial which is comprised of one half portion which is divided into 2 week end days and one half portion which is divided into the remaining 5 week days; and said computer program provides a set of instructions to said microcontroller to execute to rotate said hand one half revolution during said 2 day week end portion and one half revolution during said 5 week day portion.

12. The combination set forth in claim 1 wherein said clock is a seven-eleven clock and said display comprises a rotatable hand and a clock dial which is divided into 16 equal parts corresponding to the hours of 7 A.M. to 11 P.M.; and said computer program provides a set of instructions to said microcontroller to execute to rotate said hand one complete revolution during a 16 hour interval corresponding to the hours of 7 A.M. to 11 P.M. and to stop said hand during an 8 hour interval corresponding to the hours of 11 P.M. to 7 A.M.

13. The combination set forth in claim 1 wherein said clock is a perpetual-calendar clock and said display comprises 3 rotatable hands, one of said hands being a "day of month hand", another of said hands being a "month hand", and another of said hands being a "day of week hand" and a clock dial which is divided into annular zones, an outer zone for signaling the day of month, an intermediate zone for signaling the month, and an inner zone for signaling the day of week; and said computer program provides a set of instructions to said microcontroller to execute to rotate said "day of month hand" one revolution per month, said "month hand" one revolution per year and said "day of week hand" one revolution per week.

14. The combination recited in claim 13 wherein said "day of month hand" is a usual "minute hand", said "month hand" is a usual "hour hand" and said "day of week hand" is a usual "second hand" of a standard quartz clock.

15. The combination set forth in claim 1 wherein said clock is a forever clock and said display comprises a rotatable hand and a clock dial which is divided into 60 sectors; and said computer program provides a set of instructions to said microcontroller to execute to rotate said hand one revolution in 60 years.

16. The combination set forth in claim 2 wherein said battery is a 3 volt lithium battery.

17. The combination set forth in claim 16 wherein said lithium battery is a "solder in" battery.

18. The combination set forth in claim 16 wherein said lithium battery has a life of at least 10 years.

19. The combination set forth in claim 2 wherein said shortest solid pulse for producing a reliable tick in said movement is about a 3 volt pulse for about 12 milliseconds.

20. The combination set forth in claim 1 wherein said microcontroller is a PIC 12C508 microcontroller.

21. The combination set forth in claim 6 wherein said A.M. "open" store activity is between the hours of 8:00 A.M. and noon, said lunch activity is between the hours of noon and 1:00 P.M., said P.M. "open" store activity is between the hours of 1:00 P.M. and 5:00 P.M. and said store closed activity is between the hours of 5:00 P.M. and 8:00 A.M.

22. The combination set forth in claim 1 wherein said display is comprised of a clock dial and a pair of hands.

23. In a clock of the type having a battery, a quartz crystal oscillator, a countdown divider, a stepper motor, a gear train, an analog display and at least one hand driven by said gear train, the improvement comprising a programmable microcontroller for processing pulses from said quartz crystal oscillator to rotate and stop said hand during prescribed intervals of time for indicating with said hand at least one pair of activities during each revolution of said hand, and a computer program for providing a set of instructions to said microcontroller for rotating and stopping said hand during said prescribed intervals of time to indicate the occurrences of said pair of activities during each revolution of said hand.

24. In a clock of the type having a lithium battery, a quartz crystal oscillator for generating a 32768 Hz train of pulses, a countdown divider operatively connected to said crystal oscillator for reducing said 32768 frequency of said train of pulses to a 1 Hz. frequency, a stepper motor operatively connected to said countdown divider for driving a gear train, a gear train operatively connected to said stepper motor, and a mechanically driven hand operatively connected to said gear train, the improvement comprising: a programmable microcontroller operatively connected to said crystal oscillator, said countdown divider and said stepper motor; and a computer program for providing a set of instructions to said microcontroller to execute for providing a life of said battery of at least 10 years and indicating the occurrence of at least one pair of activities during each revolution by pulsing said stepper motor during prescribed intervals of time.

25. The improvement set forth in claim 24 wherein said computer program further includes a set of instructions for pulsing said stepper motor during each tick of said clock in a set of short intervals to extend the life of said battery.

26. The improvement set forth in claim 24 further comprising an alphanumeric display and a further set of instructions in said computer program for displaying messages on said alphanumeric display.

* * * * *